US011493194B2

(12) United States Patent
De Jong et al.

(10) Patent No.: US 11,493,194 B2
(45) Date of Patent: Nov. 8, 2022

(54) LIGHTING DEVICE MODULE FOR WIRELESS CONNECTIVITY AND CORRESPONDING METHOD

(71) Applicant: SIGNIFY HOLDING B.V., Eindhoven (NL)

(72) Inventors: Lambertus Adrianus Marinus De Jong, Son (NL); Jan De Graaf, Uden (NL); Franciscus Jacobus Vossen, Helmond (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/260,261

(22) PCT Filed: Jul. 5, 2019

(86) PCT No.: PCT/EP2019/068102
§ 371 (c)(1),
(2) Date: Jan. 14, 2021

(87) PCT Pub. No.: WO2020/016028
PCT Pub. Date: Jan. 23, 2020

(65) Prior Publication Data

US 2021/0262647 A1 Aug. 26, 2021

(30) Foreign Application Priority Data

Jul. 16, 2018 (EP) ..... 18183729

(51) Int. Cl.
*F21V 23/00* (2015.01)
*F21V 23/04* (2006.01)

(52) U.S. Cl.
CPC ..... *F21V 23/008* (2013.01); *F21V 23/045* (2013.01)

(58) Field of Classification Search
CPC ..... H05B 47/10; H05B 47/175; H05B 47/19; F21V 23/003; F21V 23/007; F21V 23/008; F21V 23/045; F21V 21/00; F21V 21/047
See application file for complete search history.

(56) References Cited

U.S. PATENT DOCUMENTS 5,803,765 A 9/1998 Peloza et al.
9,210,773 B1 12/2015 Sargent et al.
(Continued)

FOREIGN PATENT DOCUMENTS

DE 102017110791 A1 11/2017
JP 07273520 A 10/1995
WO 2018077953 A1 5/2018

*Primary Examiner* — Thai Pham

(57) ABSTRACT

An objective of the present application is to provide an improved lighting device comprising a module for enabling wireless connectivity. The invention provides a lighting device comprising a light source, a housing and a module for enabling wireless connectivity of the lighting device, wherein the module comprises: an enclosure having a first main wall opposite to a second main wall; an antenna for wireless communication, wherein the antenna is contained within the enclosure, wherein the antenna is adjacent to the first main wall; a controller in connection with said antenna for enabling the wireless connectivity of the lighting device; mounting means arranged for mounting the module to the housing in a first position wherein the first main wall abuts the housing, or in a second position wherein the second main wall abuts the housing.

20 Claims, 4 Drawing Sheets

(56) References Cited

U.S. PATENT DOCUMENTS

| | | | | |
|---|---|---|---|---|
| 9,252,481 | B2 | 2/2016 | Malek et al. | |
| 2014/0168020 | A1* | 6/2014 | Stoytchev | H01Q 9/26 343/721 |
| 2017/0339772 | A1* | 11/2017 | Ozaki | H05B 47/19 |
| 2017/0374724 | A1* | 12/2017 | Liszt | F21V 7/24 |
| 2018/0026329 | A1 | 1/2018 | Johnson et al. | |
| 2019/0289701 | A1* | 9/2019 | Oliver | H05B 47/19 |

* cited by examiner

LIGHTING DEVICE MODULE FOR WIRELESS CONNECTIVITY AND CORRESPONDING METHOD

CROSS-REFERENCE TO PRIOR APPLICATIONS

This application is the U.S. National Phase application under 35 U.S.C. § 371 of International Application No. PCT/EP2019/068102, filed on Jul. 5, 2019, which claims the benefit of European Patent Application No. 18183729.5, filed on Jul. 16, 2018. These applications are hereby incorporated by reference herein.

FIELD OF THE INVENTION

The invention relates to a lighting device comprising a light source, a housing and a module for enabling wireless connectivity of the lighting device. The invention further relates to a method of equipping a lighting device comprising a light source and a housing with a module for enabling wireless connectivity of the lighting device.

BACKGROUND OF THE INVENTION

Today, only a small fraction of lighting devices comprises wireless connectivity. It is often desired to provide a wireless connectivity to a lighting device, such as e.g. a wireless dimming functionality. Such a wireless connectivity may for example be designed into a lighting device before manufacturing accordingly. However, many lighting devices, which may benefit from such a wireless connectivity, are not initially designed for having a wireless connectivity, e.g. a wireless dimming functionality.

Therefore, as known in the lighting domain, a lighting device without a wireless connectivity designed thereinto may later be provided with an additional module, which additional module enables said wireless connectivity. DE102017110791A1 comprises an example of a wireless communication module.

However, when provided to a lighting device, such a module requires a specific positioning with respect to a housing of the lighting device and/or other components of the lighting device; because possible interference of the wireless signals by said housing and/or other components may limit the connectivity and proper functioning of the module. Thus, as there is a large variation in sizes, shapes and materials of lighting devices, universal applicability of such a module is limited, and the integration of such a module into a lighting device still requires customization, while attempting to preserve a desired level of wireless connectivity.

SUMMARY OF THE INVENTION

It is an object of the invention to provide an improved lighting device, which at least alleviates the problems and disadvantages mentioned above. Thereby, an objective of the present application is to provide an improved lighting device comprising a module for enabling wireless connectivity, such as e.g. wireless dimming control, which module may easily and widely be integrated into a large variation of such lighting devices. Thereto, the invention provides a lighting device comprising a light source, a housing and a module for enabling wireless connectivity of the lighting device, wherein the module comprises: an enclosure having a first main wall opposite to a second main wall; an antenna for wireless communication, wherein the antenna is contained within the enclosure, wherein the antenna is adjacent to the first main wall; a controller in connection with said antenna for enabling the wireless connectivity of the lighting device; mounting means arranged for mounting the module to the housing in a first position wherein the first main wall abuts the housing, or in a second position wherein the second main wall abuts the housing; wherein the first main wall of the enclosure comprises a visual indicator for indicating the antenna being adjacent to the first main wall.

Such a lighting device comprises a light source, a housing and a module for enabling wireless connectivity of the lighting device. Said module comprises an enclosure, an antenna contained within the enclosure, and a controller in connection with said antenna. The controller may also be contained within the enclosure. Therefore, the module (i.e. due to the controller in relation with the antenna) may enable wireless connectivity of the lighting device. For example, in embodiments, the wireless connectivity may comprise wireless dimming control of the light source. Hence, said controller may for example be a dimming controller, and the module may provide wireless dimming control of the light source. Even further, the present invention may also encompass all kinds of properties in controlling a light source via wireless connectivity, such as color control, modulation control, color temperature control, spectrum control, etc.

Moreover, the enclosure has a first main wall opposite to a second main wall. Since the antenna is adjacent to the first main wall, the antenna will clearly be at a distance from the second main wall. Said distance may be sufficient to prevent interference. Namely, the radiation pattern of the antenna may be affected if the antenna is near the housing of the lighting device. For example, a wireless signal of the antenna (e.g. a 2.4 GHz ZigBee signal) will be hampered by e.g. metal parts or components close to the antenna, which metal parts may detune the antenna. This may lead to poor performance in terms of connectivity. For example, whenever a material of the housing comprises a metal, it may be undesired to mount the module to the housing with the first main wall abutting the housing; because said metal housing may block and weaken the radiation pattern of the antenna. The module may therefore be affected in performance.

However, this essentially asymmetric (or preferred) positioning of the antenna within the module may also direct the radiation pattern of the antenna substantially more in the field extending in the direction of the first main wall. Thus, for example, whenever a material of the housing comprises e.g. a polymer, it may be desired to mount the module to the housing with the first main wall abutting the housing; because said polymer housing does not affect said radiation pattern and the antenna can radiate substantially more in a desired direction, i.e. substantially outward through the housing to which it is mounted. Said effect may be even more prominent whenever the antenna faces the first main wall. Hence, in an embodiment, the antenna faces the first main wall. The radiation pattern of the antenna may therefore cover the space to which the antenna is directed even more, i.e. the space lying in the direction of the first main wall.

As a result, depending on a material of said housing (and/or e.g. its shape and dimensions), the module may be desired to be mounted in different orientations in respect to the housing. Therefore, as indicated, the module has mounting means arranged for mounting the module to the housing in either a first position or a second position. The first position is characterized by the first main wall abutting the housing, whereas the second position is characterized by the second main wall abutting the housing. As a result, since each lighting device may be varying in material and dimensions, the present invention may secure the functioning of the wireless connectivity and/or wireless dimming control of the lighting device, because the module according to the invention may be more easily integrated in a lighting device and mounted in a desired position with respect to the housing. That is: either with the antenna adjacent to (and/or facing) the housing, or the antenna distant from the housing. Hence, the present invention allows for optimizing the relative positioning of the module (and the antenna contained therein) to its surroundings within the lighting device.

Thus, as mentioned, the mounting means may be arranged for mounting the module to the housing in one of a first position wherein the first main wall abuts the housing or in a second position wherein the second main wall abuts the housing. Therefore, and moreover, the present invention advantageously provides a universal module, which may serve a wide variety of lighting device configurations. Such a module according to the invention further provides minimal diversity in the supply chain and only needs one stock keeping unit (SKU), because the module may be used in a variety of different lighting devices, while enabling an optimal wireless connectivity. This is a clear improvement in terms of the manufacturing and distribution process of such a module, which is to be mounted to a lighting device for enabling a wireless connectivity.

For example: A manufacturer of luminaires comprising wireless connectivity may want third-party manufacturers of luminaires not comprising wireless connectivity to be compatible/upgradable with their wireless connectivity protocol. However, the third-party manufacturers may comprise a wide diversity of luminaires, with different shapes, sizes and/or materials. To prevent customizing modules (for wireless connectivity) for each respective luminaire, the present invention may advantageously provide a more universal module (for wireless connectivity; because the module according to the invention may be mounted to such a third-party luminaire housing in two different positions, while preserving the optimal performance of the wireless connectivity of the module.

In an embodiment, the light source may comprise a LED light source. Alternatively, the light source may comprise a high-power LED light source, or an array thereof such as a pixilated LED spot. Alternatively, the light source may be: a conventional light source, a TLED, a fluorescent tube, or a halogen spot.

As partly mentioned before, the module may either be mounted to the housing, via said mounting means, in either the first position or the second position. As the adjacency of the antenna to the first main wall may not be visible from the outset, because said antenna is contained within the enclosure of the module, it may be desirable to indicate where the antenna is located within the module, so as to provide a better understanding on how to mount said module to the housing. For example, it may be that the antenna is asymmetrically (or in a preferred position, e.g. elevated position) positioned within the enclosure of the module. Hence, as mentioned, the first main wall of the enclosure may comprise a visual indicator for indicating the antenna being adjacent to the first main wall. In an additional or alternative embodiment, the first main wall of the enclosure may comprise a visual indicator for indicating the antenna facing the first main wall. Such a visual indicator may for example be a sticker. Such visual indicator may moreover be one of a color of the first main wall or a mark indicated on the first main wall. Such a mark may for example be painted thereon, molded therein e.g. during manufacturing, or milled therein e.g. during manufacturing. Said visual indicator may also be a transparent window or an aperture within the enclosure.

In aspects, alternatively, the second main wall of the enclosure may comprise a visual indicator for indicating the position of the antenna within the enclosure of the module. Yet alternatively, in aspects, a wall of the enclosure may comprise a visual indicator for indicating the position of the antenna within the enclosure of the module.

In an embodiment, the antenna may be asymmetrically positioned within the module and its enclosure (as will further be elucidated in this application), wherein the enclosure may at least be partly (or fully) transparent, so as to provide visual means to inspect/view the exact positioning of the antenna within the module.

As partly mentioned before, as the antenna is adjacent to the first main wall of the module (and/or directed to the first main wall as it faces it), the module may have a clear orientation (or preference) in which the module enables wireless connectivity and/or its radiation pattern. In an embodiment, the module may comprise a base carrier comprising the controller and an elevated carrier comprising the antenna, wherein the base carrier and the elevated carrier are contained within the enclosure, wherein the base carrier may rest on the second main wall within the enclosure, and wherein an offset member protruding from said base carrier may be arranged for elevating said elevated carrier above said base carrier and defining a height therebetween. Here, the base carrier may e.g. comprise components or metal parts. Since the elevated carrier comprising the antenna is separated from/elevated above the base carrier, over said height, the antenna will not be influenced by any circuitry or components present on the base carrier. This may further enable an improved wireless connectivity of the module. Said height may thus be the height of the protruding member as well, mutatis mutandis.

Moreover, in an embodiment, said height may at least be 1 centimeters and at most 4 centimeters. Such a height may be advantageous for the antenna, as there is sufficient distance from the base carrier comprising the dimming controller and/or electronics and/or components associated therewith. For example, said height may be particularly advantageous for an antenna providing a 2.4 GHz ZigBee signal. Hence, in an embodiment, the antenna may be arranged for ZigBee and/or Bluetooth communication. Here, said base carrier may comprise a ZigBee chip, e.g. the ZigBee intelligence. The base carrier may for example comprise a ZigBee-Bluetooth combo chip. Alternatively, said height is at least 1 centimeters and at most 3 centimeters. Moreover, the geometric configuration of the module may be optimized by said mentioned height such that the distance of the antenna to e.g. metal components comprised on the base carrier comprising the dimming controller is maximal, while still making a compact and small module.

In an embodiment, the first main wall is parallel to the second main wall, or the first main wall is tapered in respect to the second main wall. In the former case, the first main wall is parallel to the second main wall, which enables the module (and the antenna comprised therein) to be flipped over in orientation when mounted. This provides more freedom in mounting the module. In the latter case, the first main wall is tapered in respect to the second main wall, which taper may allow the antenna comprised within the module to be under an angle in respect to the initial position when the module is flipped over to a further position. This provides more freedom to mount the module in a diversity of lighting devices, each with a different configuration. In case of such a taper, an angle between said tapered planes characterized by the first main wall and the second main wall may be at most 30 degrees, or at most 15 degrees.

Often, such modules enabling wireless connectivity may only be mountable via one of its surfaces in one orientation and/or one position. In an embodiment, the first main wall and the second main wall may be flat. Namely, the first main wall and the second main wall may be substantially flat. As the module may be mounted to the housing, having a flat first main wall and a flat second main wall of the enclosure of the module enables the module to be easily mounted to such a housing, which housing may often comprise a flat surface area. Thus, for example, the module may be specifically arranged to abut a flat main wall of its enclosure to a flat surface of the housing.

In an embodiment, the module may comprise a module material, the module material being one of: a polymer. Said polymer may for example be PE, PET, PVC, ABS, etc. In an embodiment, the housing may comprise a housing material, the housing material being one of: a polymer, a metal, a ceramic, a glass.

In an embodiment, the first main wall and/or the second main wall may comprise a thickness, said thickness being one of: 1 millimeter, 2-millimeter, 3 millimeter, between 1 and 3 millimeter, or 4 millimeters.

In an embodiment, the module (and corresponding enclosure) may be a box with a height, width, and length being respectively at most: 4 centimeters, 4 centimeters, 5 centimeters. Such a box may be advantageously compact to fit in e.g. a luminaire which is not initially designed for wireless connectivity. Alternatively, in an embodiment, said module (and corresponding enclosure) may comprise a cylindrical shape so as to fit within a cylindrical housing of a spot light.

In some examples, to e.g. further improve the wireless connectivity of the antenna, e.g. to direct the antenna pattern into a space lying the direction of the first main wall, the housing may comprise an aperture. Hence, in an alternative embodiment, the housing may comprise an aperture in an interface area where the first main wall abuts the housing. Such an aperture may for example be established in a metal housing of the lighting device. The lighting device may further comprise a lid, panel or plug to close said aperture. Said interface may be surface area of the housing.

In an embodiment, the mounting means may be configured to detachably mount the module to the housing in said first position or said second position. Having mounting means which may be configured to detachably mount the module to the housing provides more flexibility in mounting the module to the housing in said first position or said second position, because the position of the module may easily be amended by detaching and remounting the module.

In an embodiment, the mounting means may comprise at least one of: a throughput hole in the enclosure extending from the first main wall to the second main wall, wherein the throughput hole is arranged for accommodating a fastening element therethrough; Velcro (e.g., hook-and-loop fastener); an adhesive surface area; at least one teeth for snap fitting the module into at least one respective slot, wherein the housing comprises said at least one respective slot; a magnetic member for magnetically connecting to a magnetic area, wherein the housing comprises said magnetic area.

Such a throughput hole may extend through said base carrier and/or said elevated carrier. Such a throughput hole may accommodate a fastening element therethrough being for example one of: a screw, a bolt, a pin, a rivet, a wire, and/or a nail. In some examples, said fastening element may extend through said base carrier and said elevated carrier, and thereby capacitively coupling the base carrier with the elevated carrier so as to enlarge the ground body of the elevated carrier comprising the antenna. This may improve the RF functionality of the module.

Furthermore, said adhesive surface area may be advantageous, as no additional element is required in respect to the module. Such an adhesive surface area may for example be glue, double sided tape, or re-attachable (double sided) tape, or adhesive paste. Furthermore, said Velcro may be advantageous as it may provide an easy and low-cost detachable mounting means. The module may also be more flexibility attached, because using Velcro, small adjustments in positioning are easily possible. Similar argumentation may apply for a magnetic member, which may additionally be advantageous for mounting said module to a metal housing; which mounting means with said magnetic member may further also not requires additional elements. Furthermore, said snap fitting may be according to known snap fitting techniques. Alternatively, said mounting means may be established by the module comprising a shape or perimeter which is being suitable for press fitting.

As mentioned before, the module has mounting means arranged for mounting the module to the housing in either a first position or a second position. The first position is characterized by the first main wall abutting the housing, whereas the second position is characterized by the second main wall abutting the housing. The radiation pattern of the antenna may however be affected in performance if the antenna is near the housing of the lighting device. For example, whenever a material of the housing comprises a metal, it may be undesired to mount the module to the housing with the first main wall abutting the housing; because said metal housing may block and weaken the radiation pattern of the antenna. Hence, in an embodiment, the module may be mounted to the housing in the first position when the housing material is a metal, or the module may be mounted to the housing in the second position when then housing material is a polymer.

Furthermore, as mentioned before, the module may enable, in operation, wireless connectivity of the lighting device, such as e.g. wireless dimming control of the light source. Generally, in one embodiment, the lighting device may further comprise a driver for powering the light source; and wherein the controller of the module may be further arranged to receive power, to determine a level, and to convey said received power to the driver at the determined level so as to provide wireless control of the light source. Said level may for example be a color level, an intensity level, a color temperature level, or associated with a control command. It may for example be advantageous to provide wireless dimming control of the light source, because dimming may be a key feature in lighting control as it defines an intensity of the light source. Hence, in a further embodiment, the lighting device may further comprise a driver for powering the light source; and wherein the controller of the module may be further arranged to receive power, to determine a dimming level, and to convey said received power to the driver at the determined dimming level so as to provide wireless dimming control of the light source. Thereby, said controller may thus be a dimming controller. The dimming controller may be suitable for phase cut dimming. Thus, the module may provide the lighting driver with a controlled mains power, which mains power may be fed to the module via a mains cable. Thus, the module may additionally comprise a terminal block for connecting a mains cable. The module thus advantageously enables wireless dimming control of the light source of a lighting device which may initially not been designed for wireless dimming control. Said dimming level may be communicated to the controller via said antenna. Hence, the dimming controller and said antenna may be in connection with each other via known means in electronics, such as wiring or tracks, which enables signals to be communicated. Such a signal may for example be a dimming command comprising a dimming level.

It is a further object of the invention to provide an improved lighting system, which at least alleviates the problems and disadvantages mentioned above. Thereto, the invention further provides, a lighting system comprising: a lighting device according to the invention, and a remote device for wirelessly controlling the lighting device. Said controlling may for example be wirelessly dimming control, and/or wireless color control, wireless color temperature control, wireless modulation control, etc. Moreover, for example, said remote device may be arranged for sending a command, such as a wireless dimming command, to the antenna of the module of the lighting device so as to enable connectivity functions, such as e.g. wireless dimming control, to the light source of the lighting device. Moreover, said remote device may also control said lighting device, for which the wireless connectivity is enabled by the module according to the invention, via a bridge device, which bridge device may also be part of the lighting system.

The advantages and/or embodiments applying to the lighting device according to the invention may also apply mutatis mutandis to the present lighting system according to the invention.

It is a further object of the invention to provide an improved method of equipping a lighting device comprising a light source and a housing with a module for enabling wireless connectivity of the lighting device, such as for example wireless dimming control of the light source, which at least alleviates the problems and disadvantages mentioned above. Thereto, the invention further provides: A method of equipping a lighting device comprising a light source and a housing with a module for enabling wireless connectivity of the lighting device; wherein the module comprises: an enclosure having a first main wall opposite to a second main wall; an antenna for wireless communication, wherein the antenna is contained within the enclosure, wherein the antenna is adjacent to the first main wall; a controller in connection with said antenna for enabling the wireless connectivity of the lighting device; wherein the method comprises: mounting the module to the housing, by mounting means, in a first position wherein the first main wall abuts the housing, or in a second position wherein the second main wall abuts the housing.

Moreover, in an embodiment, the method according to the invention is provided, wherein the method may further comprise: mounting the module to the housing in the first position when a housing material of the housing is a metal, or mounting the module to the housing in the second position when a housing material of the housing is a polymer.

The method may (additionally) be a method of enabling wireless connectivity of said lighting device.

In an embodiment, the method according to the invention is provided, wherein the lighting device may further comprise a driver for powering the light source; wherein the method may further comprise, performed by the controller of the module: receiving power; determining a level; conveying said received power to the driver at the determined level. Said level may for example be a color level, an intensity level, a color temperature level, or associated with a control command.

It may for example be advantageous to provide wireless dimming control of the light source, because dimming may be a key feature in lighting control as it defines an intensity of the light source. Hence, in a further embodiment, the method according to the invention is provided, wherein the lighting device may further comprise a driver for powering the light source; wherein the method may further comprise, performed by the controller of the module: receiving power; determining a dimming level; conveying said received power to the driver at the determined dimming level. The controller may thus be a wireless dimming controller.

In an embodiment, the method according to the invention is provided, wherein the method further comprises: receiving, by the antenna of the module, a wireless command comprising the level; communicating said level to said controller.

In an embodiment, the method according to the invention is provided, wherein the method further comprises: receiving, by the antenna of the module, a wireless dimming command comprising the dimming level; communicating said dimming level to said dimming controller.

In a further embodiment, the method according to the invention is provided, wherein the method may further comprise, performed by a remote device, sending the wireless command, such as the wireless dimming command in some of said examples, to the antenna of the lighting device.

The advantages and/or embodiments applying to the lighting device and/or the lighting system according to the invention may also apply mutatis mutandis to the present method according to the invention.

Moreover, in aspects, said lighting device may be a kit of parts comprising a light source, a housing, and a module according to the invention; which in assembly form a lighting assembly and/or lighting device (according to the invention). The advantages and/or embodiments applying to the lighting device and/or the lighting system according to the invention may also apply mutatis mutandis to the present kit of parts according to the invention.

Moreover, in aspects, the invention may provide the module according to the invention, as described before, in relation to the lighting device.

BRIEF DESCRIPTION OF THE DRAWINGS

The invention will now be further elucidated by means of the schematic non-limiting drawings.

DETAILED DESCRIPTION OF THE EMBODIMENTS

As mentioned: It is an object of the invention to provide an improved lighting device, which comprises a module for enabling wireless connectivity, wherein the module may easily and widely be integrated into a large variation of such lighting devices. Therefore, the present invention provides a universal module, which may serve a wide variety of lighting device configurations; and/or further provides minimal diversity in the supply chain and only one stock keeping unit, because the module may be used in a variety of different lighting devices, while enabling an optimal wireless connectivity.

Figure 1:
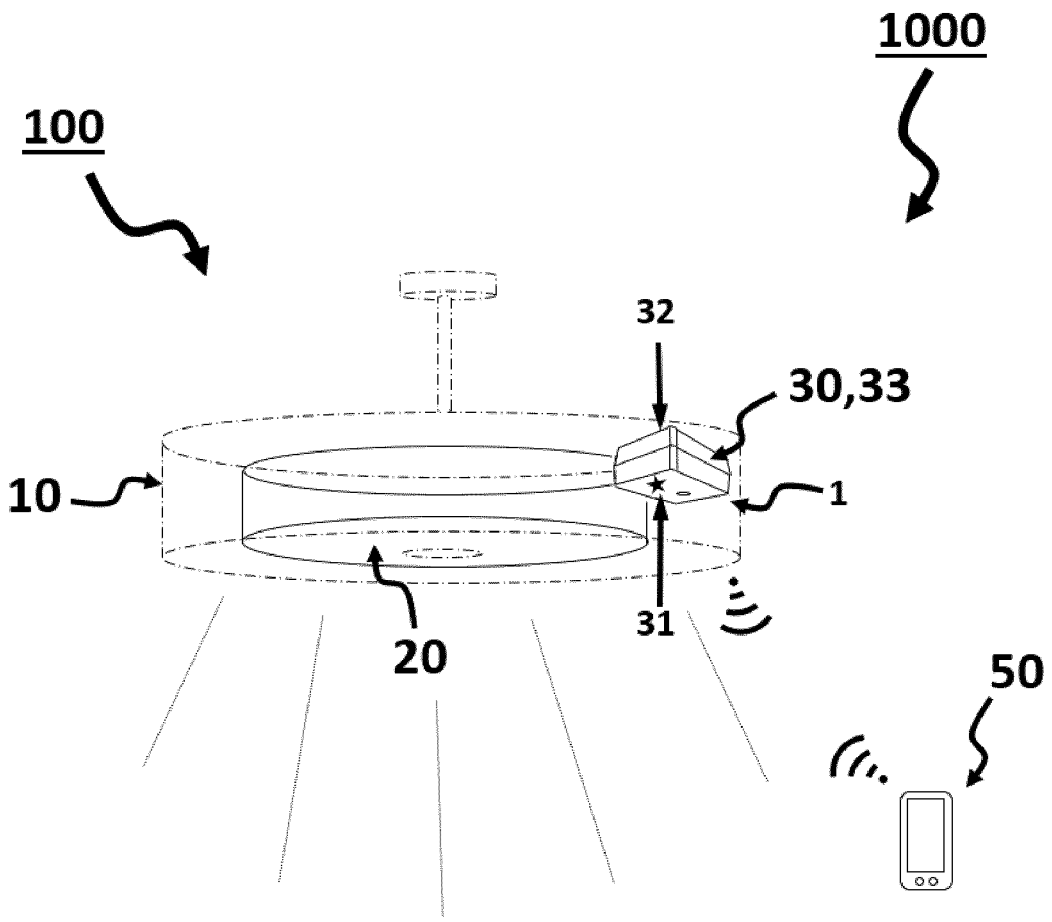
FIG. 1 depicts schematically an embodiment of a lighting system comprising the lighting device according to the invention and a remote device, wherein the lighting device comprises a light source, a housing and a module.

FIG. 1 depicts schematically, by non-limiting example, an embodiment of a lighting system 1000 comprising the lighting device 100 according to the invention and a remote device 50. Here, in the present example, the lighting device 100 is a ceiling luminaire. It may alternatively be any other type of luminaire. The lighting device 100 comprises a light source 20, a housing 10 and a module 30 for enabling wireless connectivity of the lighting device 100. The remote device 50 is arranged to wirelessly control the lighting device 100 by communicating with the module 30. The remote device is a smartphone, but may alternatively be one of: a tablet, a wearable, a commissioning device, a computer, a bridge, a server, another smart-lamp, a vehicle, etc. Said wirelessly controlling is wirelessly controlling the dimming of the lighting device 100, but may alternatively comprise wirelessly controlling one of: color, color temperature, modulation, on/off state, or any other known lighting property, etc. The device 50 and the module 30 of the lighting device 100 communicate via ZigBee and/or Bluetooth, such as via a 2.4 GHz ZigBee signal, but may alternatively communicate via one of: Wi-Fi, Infrared, RF, Visible Light Communication, LiFi, LoRa, Bluetooth, etc.

The light source 20 is a LED array, which is embodied in a LED module, which (optionally) comprises a light guide and/or optics for directing the emitted light. Hence, the light source 20 may take a relatively large volume within the lighting device 100. Alternatively, said light source may be one of a high-power LED light source, or an array thereof such as a pixilated LED spot. Alternatively, the light source may be: a conventional light source, a TLED, a fluorescent tube, or a halogen spot.

Figure 2:
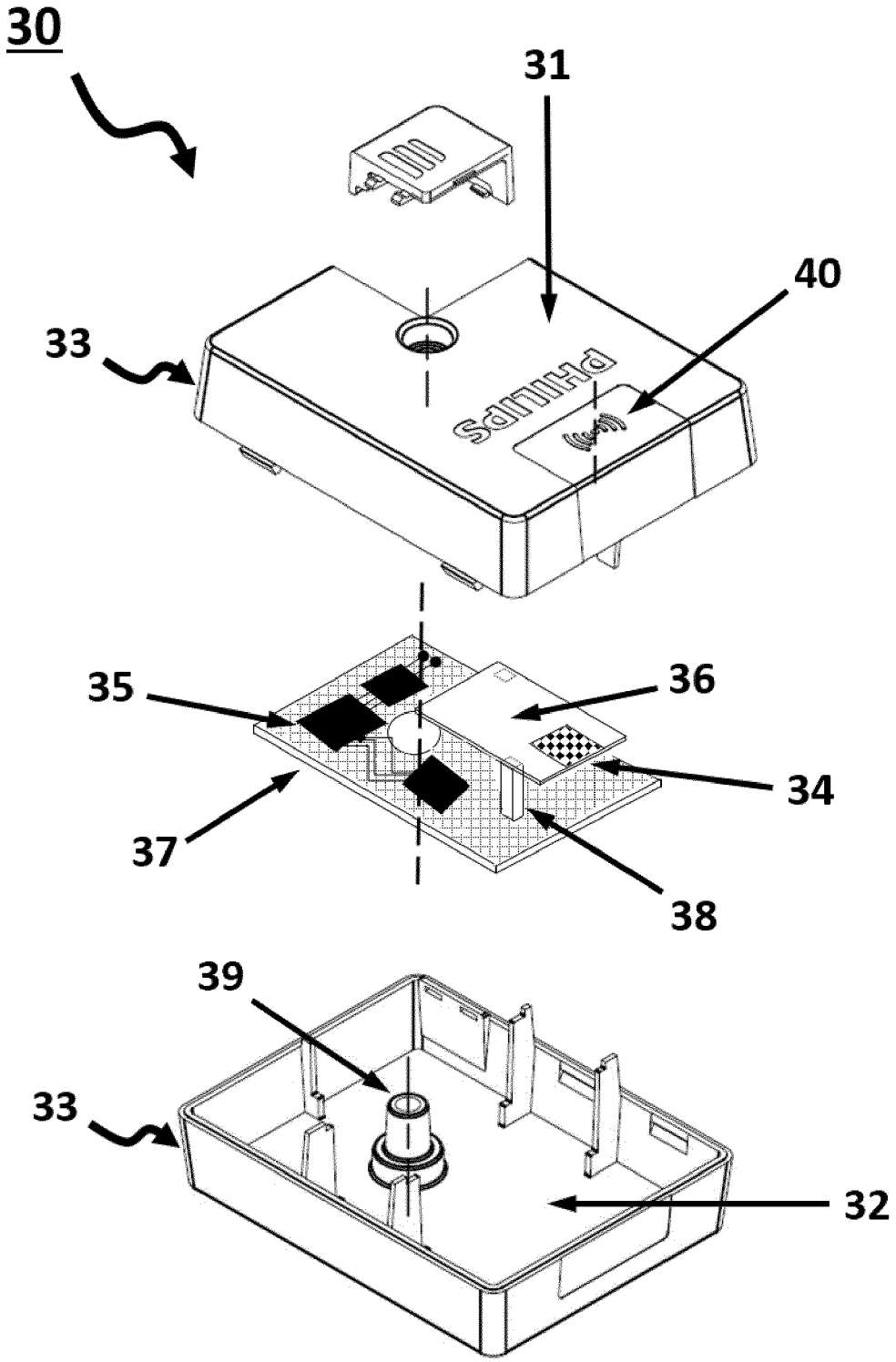
FIG. 2 depicts schematically an embodiment of the module according to the invention in perspective view.
Figure 3A:
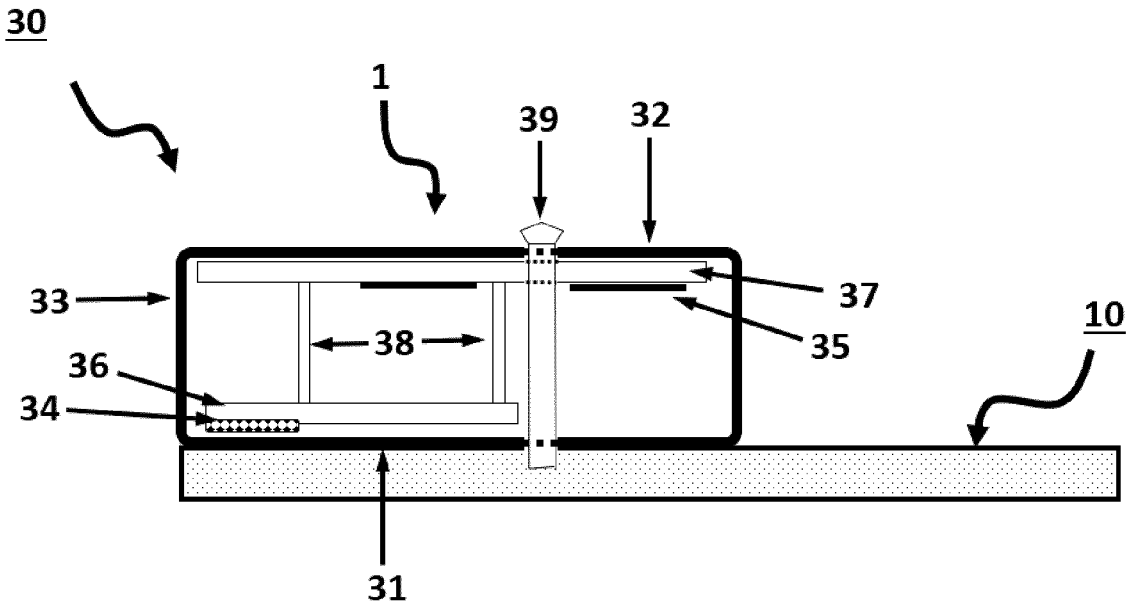
FIG. 3A and FIG. 3B depict schematically an embodiment of the module according to the invention in side view in respectively the first position according to the invention and the second position according to the invention.
Figure 3B:
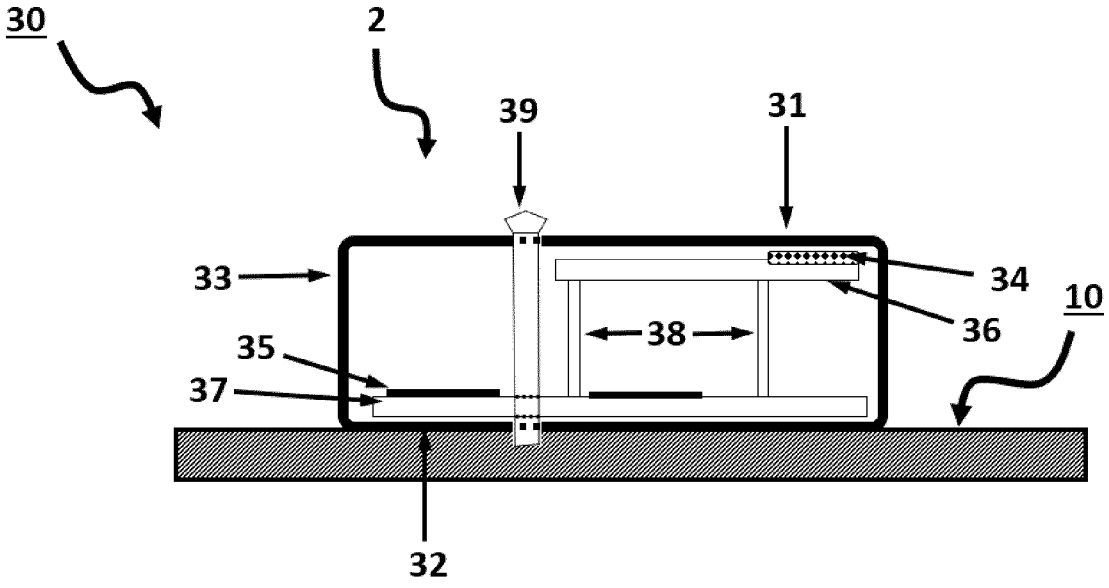

FIG. 2, FIG. 3A and FIG. 3B depict, by non-limiting example, the lighting module 30 according to the invention. Referring thereto and also referring back to FIG. 1: As mentioned, the lighting device 100 comprises a module 30 for enabling wireless connectivity of the lighting device 100, i.e. here the wireless dimming control of the light source 20. The module 30 comprises an enclosure 33 having a first main wall 31 which is opposite to a second main wall 32. The module 30 is injection molded and comprises a module material being a polymer, such as PE, ABS, PET, PVC, etc. Alternatively, other manufacturing methods may be used to produce said module. The first main wall 31 is parallel to the second main wall 32, because the module 30 is essentially a rectangular box. The first main wall 31 and the second main wall 32 are therefore (substantially) flat surfaces. Such a flat surface of the first main wall 31 and the second main wall 32 of the enclosure 33 of the module 30 facilitates mounting the module 30 to another flat surface, such as e.g. a surface of a housing of a lighting device. Alternatively, not depicted, the module may comprise a different shape, wherein said first main wall may be tapered in respect to said second main wall. This allows for the module to be mounted under an angle when turning around the module from the first main wall to the second main wall. This alternative provides more freedom to mount the module in a diversity of lighting devices, each with a different configuration.

Still referring to FIG. 1, FIG. 2, FIG. 3A and FIG. 3B; the module 30 further comprises an antenna 34 contained within the enclosure 33. The antenna 34 provides amongst others the wireless connectivity and essentially the transceiving means for communicating with the remote device 50. The antenna 34 is adjacent to the first main wall 31. Thus, the antenna 34 is clearly at a distance from the second main wall 32. Here, the antenna 34 also faces the first main wall 31, so as to provide a radiation pattern of the antenna 34 being directed more to the space lying in the direction of the first main wall, i.e. e.g. the room/environment below the lighting device 100 wherein the remote device 50 is present. Nevertheless, alternatively, said antenna may be omnidirectional and have an alternative radiation pattern, as known in the field of antenna's.

Still referring to FIG. 1, FIG. 2, FIG. 3A and FIG. 3B; the module 30 further comprises a controller 35 contained within the enclosure 33 and in connection with the antenna 34. Such a connection may mean that signals are communicated between both components. The controller is a wireless dimming controller 35, but may alternatively be any other controller suitable for providing processing power for wireless connectivity functions. Yet alternatively, said controller may be a distributed controller and/or a controller not contained (partly or fully) within the enclosure.

Moreover, in the present embodiment, the module 30 comprises a base carrier 37 comprising the controller 35 and an elevated carrier 36 comprising the antenna 34. The base carrier 37 rests on the second main wall 32 within the enclosure 33. The base carrier 37 further comprises an offset member 38 protruding from said base carrier 37, which offset member 38 holds and elevates said elevated carrier 36 above said base carrier 37 and defines a height therebetween. Here, this height is 3 centimeters, but may alternatively be at least 1 centimeters and at most 4 centimeters, or alternatively at most 5 centimeters. The base carrier 37 may further comprise further components, such as a capacitor, chipsets, tracks, resistances, insulation, etc.

Still referring to FIG. 1, FIG. 2, FIG. 3A and FIG. 3B; as mentioned, the enclosure 33 has the first main wall 31 opposite and parallel to the second main wall 32. Since the antenna 34 is adjacent to the first main wall 31, the antenna 34 is clearly at a distance from the second main wall 32, which distance is at least the mentioned height established by the offset member 38. Said distance may be sufficient to prevent interference. Namely, the radiation pattern of the antenna 34 may be affected if the antenna 34 is near the housing 10 of the lighting device 100. For example, a wireless signal of the antenna 34 (e.g. a 2,4 GHz ZigBee signal) will be hampered by e.g. metal parts or (electrical) components close to the antenna 34, which metal parts and/or components may detune the antenna 34. This may lead to poor performance in terms of connectivity.

The module 30 may be mounted to the housing 10 of the lighting device 100 in different positions. The first position 1 is characterized by the first main wall 31 abutting the housing 10, whereas the second position 2 is characterized by the second main wall 32 abutting the housing 10.

For example, referring to FIG. 3B specifically, wherein a material of the housing 10 comprises a metal, such as stainless steel, it may be undesired to mount the module 30 to the housing 10 with the first main wall 31 abutting the housing 10; because said metal housing 10 may block and weaken the radiation pattern of the antenna 34. The module 30 may therefore be affected in performance. Instead, it may be desired to mount the antenna 34 to the metal housing 10 in the second position 2 wherein the second main wall 32 abuts the metal housing 10. Alternatively, not depicted, the housing may comprise an aperture in an interface area where the first main wall abuts the housing, through which aperture the radiation pattern of the antenna may additionally 'escape'.

However, the essentially asymmetric (or preferred) positioning of the antenna 34 within the module 30 may also direct the radiation pattern of the antenna 34 substantially more in the direction of the first main wall 31, e.g. to said room/environment below the lighting device 100 wherein the remote device 50 is present. Thus, for example, alternatively, referring to FIG. 3A specifically, wherein a material of the housing comprises e.g. a polymer, it may be desired to mount the module 30 to the housing 10 in the first position 1 with the first main wall 31 abutting the housing 10; because said polymer housing 10 does not affect said radiation pattern and the antenna 34 can radiate substantially more in said desired direction, i.e. substantially outward through the housing 10 to which it is mounted.

As a result, still referring to FIG. 3A and FIG. 3B, depending on a material of said housing 10 (and/or alternatively e.g. its shape and dimensions), the module 30 may be desired to be mounted in different orientations in respect to the housing 10. Hence, the module 30 may be mounted to the housing 10 in the first position 1 when the housing material is a metal, or the module 30 may be mounted to the housing 10 in the second position 2 when then housing material is a polymer.

In the present embodiment, referring to FIG. 1, FIG. 2 and FIG. 3B, the housing 10 of the lighting device 10 (i.e. the ceiling luminaire) comprises a steel metal exterior. Alternatively, the housing may comprise a housing material being one of: a polymer, a metal, a ceramic, a glass. The module 30 needs to be mounted to this housing 10 due to space considerations, as the ceiling luminaire was not initially designed for having a wireless connectivity function. Therefore, the module 30 is mounted to the housing 10 in the second position 2 wherein the second main wall 32 abuts the housing 10. This second position 2 ensures that the antenna 34 is sufficiently clear from the metal housing 10 and has an improved connectivity.

The module 30 has mounting means 39 arranged for mounting the module 30 to the housing 10 in either the first position 1 or the second position 2. The mounting means 39 for mounting the module 30 to the housing is here a throughput hole 39 in the enclosure 33 extending from the first main wall 31 to the second main wall 32, wherein the throughput hole 39 is arranged for accommodating a fastening element (not depicted) therethrough. This fastening element (not depicted) is a screw (not depicted). Alternatively, said fastening element may be one of a bolt, a pin, a rivet, a wire, and/or a nail. The screw may be screwed into the housing via said throughput hole 39 in both directions (i.e. from the first main wall 31 to the second main wall 32, or vice versa), wherein said both directions respectively correspond to the module 30 being mounted in respectively the first position 1 or the second position 2. Due to the mounting means 39 being a throughput hole 39 for receiving a screw (not depicted), the module 30 can be detachably fixated to said housing 10 in either said first position 1 or said second position.

Alternatively, the mounting means may be one of: Velcro; an adhesive surface area; at least one teeth for snap fitting the module into at least one respective slot, wherein the housing comprises said at least one respective slot; a magnetic member for magnetically connecting to a magnetic area, wherein the housing comprises said magnetic area.

In some examples, alternatively and/or additionally, said fastening element may extend through said base carrier and said elevated carrier, and thereby capacitively coupling the base carrier with the elevated carrier so as to enlarge the ground body of the elevated carrier comprising the antenna. This may improve the RF functionality of the module.

As a conclusion, since each lighting device 100 may be varying in material and dimensions, the present invention may secure the functioning of the wireless connectivity and/or wireless dimming control of the lighting device 100, because the module 30 according to the invention may be more easily integrated in a lighting device 100 and mounted in a desired position with respect to the housing 10. That is: either with the antenna 34 adjacent to (and/or facing) the housing 10, or the antenna 34 distant from the housing 10 as is depicted here. Hence, the present invention allows for optimizing the relative positioning of the module 30 (and the antenna 34 contained therein) to its surroundings within the lighting device 100.

Still referring to FIG. 1 and FIG. 2, as partly mentioned before, the module 30 may either be mounted to the housing 10, via said mounting means 39, in either the first position 1 or the second position 2; which is here the second position 2. As the adjacency of the antenna 34 to the first main wall 31 may not be visible from the outside of the module 30 and its enclosure 33, because said antenna 34 is contained within the enclosure 33 of the module 30, it is desirable to indicate where the antenna 36 is located within the module 30, so as to provide a better understanding on how to mount said module 30 to the housing 10. Hence, the first main wall 31 of the enclosure 33 comprises a visual indicator 40 for indicating the antenna 34 being adjacent to the first main wall 31. Said indicator 40 is a Philips mark engraved or molded within the first main wall 31, i.e. e.g. at the location where the antenna 34 is adjacent to the first main wall 31. Said indicator 40 may alternatively be a sticker, or a color of the first main wall, or a protrusion indicated on the first main wall.

In an embodiment similar to the embodiment depicted in FIG. 1, but not depicted here, the lighting device further comprise a driver for powering the light source. The controller of the module is further arranged to receive power. This power may be received from mains power, which is connected to e.g. a terminal block within the module. Alternatively, said module may be battery powered and receive said power from a battery. The controller of the module is further arranged to determine a level, and to convey said received power to the driver at the determined level so as to provide wireless control of the light source. The level is a dimming level and said wireless control is a corresponding wireless dimming control of the light source, but may alternatively be a color level, an intensity level, a color temperature level, or associated with a control command; and the wireless control may be a corresponding wireless control of the light source.

Figure 4:
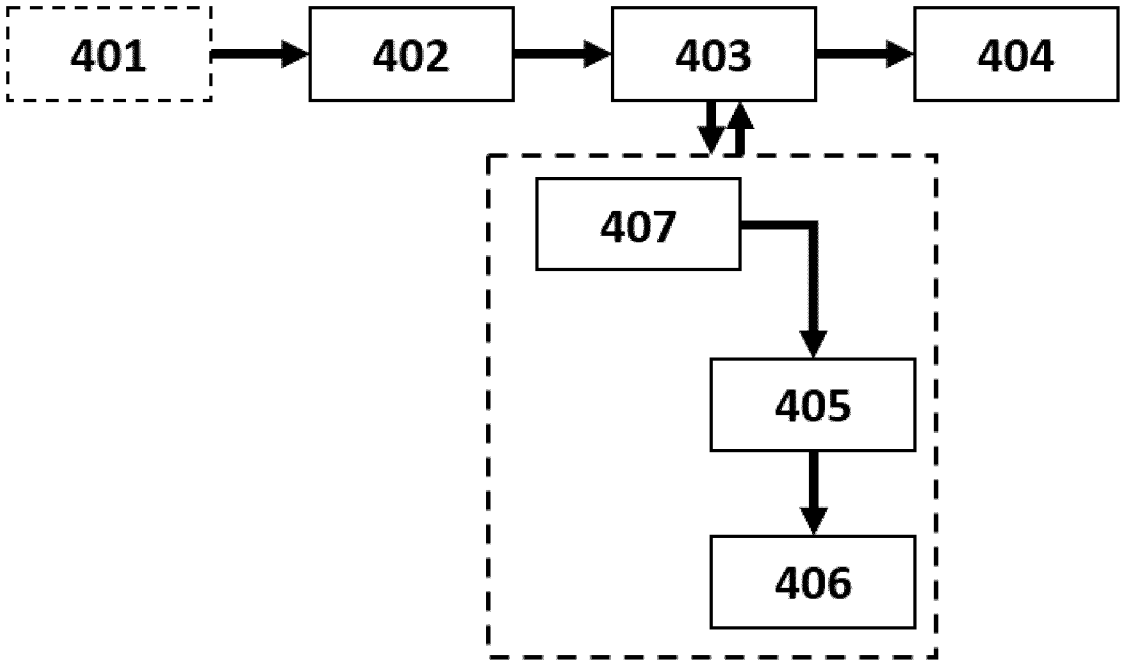
FIG. 4 depicts schematically, within a flowchart, an embodiment of a method of equipping a lighting device comprising a light source and a housing with a module for enabling wireless connectivity of the lighting device, and the control thereof.

FIG. 4 depicts schematically, by non-limiting example, within a flowchart, a method 400 of equipping a lighting device 100 according to the invention with a module 30 for enabling wireless connectivity, such as e.g. a wireless dimming control. As mentioned before, said lighting device according to the invention comprises a light source 20 and a housing 10. The module 30 enables the wireless connectivity of the lighting device 100. The module 30 comprises an enclosure 33 having a first main wall 31 opposite to a second main wall 31. The module 30 further comprises an antenna 34 for wireless communication, wherein the antenna 34 is contained within the enclosure 33, wherein the antenna 34 is adjacent to the first main wall 31. The module 30 further comprises a controller 35 in connection with said antenna 34 for enabling the wireless connectivity of the lighting device 100. The method comprises the step of: 401 mounting the module to the housing 10, by mounting means 39 as mentioned, in a first position 1 wherein the first main wall 31 abuts the housing 10, or in a second position 2 wherein the second main wall 32 abuts the housing 10.

Moreover, in an embodiment, the method according to the invention is provided, wherein the method further comprises: mounting the module to the housing in the first position when a housing material of the housing is a metal, or mounting the module to the housing in the second position when a housing material of the housing is a polymer. Moreover, another step of the method 400 may be related to the wireless connectivity function of the lighting device 100 equipped with said module 30 for enabling wireless connectivity. The lighting device 100 therefore further comprises a driver (not depicted) for powering the light source 20. The method comprises the steps of, performed by the controller 35 of the module 30: 402 receiving power; 403 determining a dimming level; 404 conveying said received power to the driver (not depicted) at the determined dimming level. Even further, another step of the method comprises: 405 receiving, by the antenna 34 of the module 30, a wireless command comprising the dimming level; 406 communicating said level to said controller 35. Even further, another step of the method comprises: 407 performed by a remote device, sending the wireless command to the antenna of the lighting device. Said dimming level may for example alternatively be a color level, an intensity level, a color temperature level, or associated with a control command.

The invention claimed is:

1. A lighting device comprising a light source, a housing and a wireless communication module, wherein the wireless communication module comprises:
- an enclosure having a first main wall opposite to a second main wall;
- an antenna for wireless communication, wherein the antenna is contained within the enclosure and is adjacent to the first main wall;
- a controller in connection with said antenna for enabling the wireless connectivity of the lighting device;
- a mounting means arranged for mounting the wireless communication module to the housing in at least one of a first position, wherein the first main wall abuts the housing, and in a second position, wherein the second main wall abuts the housing;
- wherein the first main wall of the enclosure comprises a visual indicator for indicating the antenna being adjacent to the first main wall; and
- wherein the wireless communication module further comprises a base carrier comprising the controller and an elevated carrier comprising the antenna, wherein the base carrier and the elevated carrier are contained within the enclosure; wherein the base carrier rests on the second main wall; and wherein an offset member protruding from said base carrier is arranged for elevating said elevated carrier above said base carrier and defining a height therebetween.

2. The lighting device according to claim 1, wherein the visual indicator is positioned at a location of the first main wall where the antenna is adjacent to the first main wall.

3. The lighting device according to claim 1, wherein said height is at least 1 centimeters and at most 4 centimeters.

4. The lighting device according to claim 1, wherein the first main wall and the second main wall are flat.

5. The lighting device according to claim 1, wherein the housing comprises an aperture in an interface area where the first main wall abuts the housing.

6. The lighting device according to claim 1, wherein the mounting means are configured to detachably mount the wireless communication module to the housing in at least one of said first position and said second position.

7. The lighting device according to claim 1, wherein the wireless communication module comprises a module material, the module material being a polymer.

8. The lighting device according to claim 1, wherein the housing comprises a housing material, the housing material being one of: a polymer, a metal, a ceramic, or a glass.

9. The lighting device according to claim 1, wherein the wireless communication module is mounted to the housing in the first position when the housing material is a metal, or wherein the wireless communication module is mounted to the housing in the second position when the housing material is a polymer.

10. The lighting device according to claim 1,
- wherein the lighting device further comprises a driver for powering the light source; and
- wherein the controller is further arranged to receive power, to determine a dimming level, and to convey said received power to the driver at the determined dimming level so as to provide wireless dimming control of the light source.

11. A lighting device comprising a light source, a housing and a wireless communication module, wherein the wireless communication module comprises:
- an enclosure having a first main wall opposite to a second main wall;
- an antenna for wireless communication, wherein the antenna is contained within the enclosure and is adjacent to the first main wall;
- a controller in connection with said antenna for enabling the wireless connectivity of the lighting device;
- a mounting means arranged for mounting the wireless communication module to the housing in at least one of a first position, wherein the first main wall abuts the housing, and in a second position, wherein the second main wall abuts the housing;
- wherein the first main wall of the enclosure comprises a visual indicator for indicating the antenna being adjacent to the first main wall;
- a throughput hole in the enclosure extending from the first main wall to the second main wall, wherein the throughput hole is arranged for accommodating a fastening element therethrough;
- a hook-and-loop fastener;
- an adhesive surface area;
- at least one tooth for snap fitting the wireless communication module into at least one respective slot, wherein the housing comprises said at least one respective slot; and
- a magnetic member for magnetically connecting to a magnetic area, wherein the housing comprises said magnetic area.

12. The lighting device according to claim 11, wherein the visual indicator is positioned at a location of the first main wall where the antenna is adjacent to the first main wall.

13. The lighting device according to claim 11, wherein the wireless communication module further comprises a base carrier comprising the controller and an elevated carrier comprising the antenna, wherein the base carrier and the elevated carrier are contained within the enclosure; wherein the base carrier rests on the second main wall; and wherein an offset member protruding from said base carrier is arranged for elevating said elevated carrier above said base carrier and defining a height therebetween.

14. The lighting device according to claim 13, wherein said height is at least 1 centimeters and at most 4 centimeters.

15. The lighting device according to claim 11, wherein the first main wall and the second main wall are flat.

16. The lighting device according to claim 11, wherein the housing comprises an aperture in an interface area where the first main wall abuts the housing.

17. The lighting device according to claim 11, wherein the mounting means are configured to detachably mount the wireless communication module to the housing in at least one of said first position and said second position.

18. A method of equipping a lighting device for wireless connectivity, the method comprising:

mounting a wireless communication module to a housing using a mounting means in one of a first position, wherein a first main wall abuts the housing, or in a second position, wherein a second main wall abuts the housing;

wherein the lighting device includes a light source, the housing and the wireless communication module;

wherein the wireless communication module includes an enclosure having a first main wall opposite to a second main wall, an antenna for wireless communication, the antenna being contained within the enclosure and being adjacent to the first main wall, a controller in connection with the antenna for enabling the wireless connectivity of the lighting device;

wherein the first main wall of the enclosure comprises a visual indicator for indicating the antenna being adjacent to the first main wall; and wherein the wireless communication module further comprises a base carrier comprising the controller and an elevated carrier comprising the antenna, wherein the base carrier and the elevated carrier are contained within the enclosure; wherein the base carrier rests on the second main wall; and wherein an offset member protruding from said base carrier is arranged for elevating said elevated carrier above said base carrier and defining a height therebetween.

19. The method according to claim 18, the method further comprising:

driving the light source with power using a driver;

receiving power at the controller of the wireless communication module;

determining, by the controller, a dimming level; and conveying said received power to the driver at the determined dimming level.

20. The method according to claim 19, wherein the method further comprises:

receiving, by the antenna of the wireless communication module, a wireless dimming command comprising the dimming level; and communicating said dimming level to said controller.

* * * * *